US008262517B2

(12) United States Patent
Balasubramanyan

(10) Patent No.: US 8,262,517 B2
(45) **Date of Patent: *Sep. 11, 2012**

(54) SENSOR BASED TENNIS SERVE TRAINING APPARATUS

(76) Inventor: Ramesh Balasubramanyan, Salem, OR (US)

( * ) Notice: Subject to any disclaimer, the term of this patent is extended or adjusted under 35 U.S.C. 154(b) by 40 days.

This patent is subject to a terminal disclaimer.

(21) Appl. No.: 12/910,701

(22) Filed: Oct. 22, 2010

(65) Prior Publication Data

US 2012/0004055 A1 Jan. 5, 2012

Related U.S. Application Data

(63) Continuation-in-part of application No. 11/823,418, filed on Jun. 27, 2007, now abandoned.

(60) Provisional application No. 61/256,225, filed on Oct. 29, 2009.

(51) Int. Cl.
*A63B 69/38* (2006.01)
*A63B 69/00* (2006.01)

(52) U.S. Cl. ..... 473/459; 473/422; 473/451

(58) Field of Classification Search ..... 473/422, 473/431, 451, 459, 461; 124/1, 6, 45
See application file for complete search history.

(56) References Cited

U.S. PATENT DOCUMENTS 3,231,271 A * 1/1966 Murphy ..... 473/461
3,807,379 A * 4/1974 Vodinh ..... 124/26
3,966,205 A * 6/1976 Schain et al. ..... 473/462
4,021,036 A * 5/1977 Nelson et al. ..... 473/459
4,023,798 A * 5/1977 Pronin ..... 473/462
4,108,432 A * 8/1978 Clark et al. ..... 473/431
4,141,550 A * 2/1979 Denizman ..... 473/462
4,565,527 A * 1/1986 Burchett ..... 434/248
4,702,475 A * 10/1987 Elstein et al. ..... 273/445
4,718,668 A * 1/1988 Schipske ..... 473/462
4,915,384 A * 4/1990 Bear ..... 473/451
5,011,143 A * 4/1991 Jones ..... 473/459
5,066,010 A * 11/1991 Pingston ..... 473/451
5,097,985 A * 3/1992 Jones ..... 221/86
5,292,119 A * 3/1994 Norcross ..... 473/451
5,520,397 A * 5/1996 Thompson ..... 473/459
5,669,834 A * 9/1997 Slupskiy ..... 473/459

(Continued)

FOREIGN PATENT DOCUMENTS

DE 3805309 C1 * 8/1989

(Continued)

OTHER PUBLICATIONS

Translation for JP02005218757.*

*Primary Examiner* — Mitra Aryanpour
(74) *Attorney, Agent, or Firm* — Rylander & Associates PC; Kurt M. Rylander

(57) ABSTRACT

A sensor based tennis serve training apparatus includes a stand, a ball tosser coupled to said stand, an optical marker coupled to said stand and in electronic communications with said ball tosser, the optical marker to mark a ball strike zone, an ultrasonic tennis arm movement detector attached to said stand and in electronic communication with said ball tosser to detect arm movement, and a selectively timed ball discharging magazine attached to said stand and in electronic communication with said ball tosser. Said apparatus can further include an electronic communication control box coupled to said stand and mediating electronic communication between said magazine, ball tosser, ultrasonic tennis arm movement detector, and optical marker.

3 Claims, 9 Drawing Sheets

U.S. PATENT DOCUMENTS

| | | | | | |
|---|---|---|---|---|---|
| 5,700,204 | A | * | 12/1997 | Teder | 473/199 |
| 5,980,399 | A | * | 11/1999 | Campbell et al. | 473/459 |
| 6,042,492 | A | * | 3/2000 | Baum | 473/453 |
| 6,592,465 | B2 | * | 7/2003 | Lutz et al. | 473/198 |
| 6,616,555 | B2 | * | 9/2003 | Bewley | 473/451 |
| 6,776,732 | B2 | * | 8/2004 | Parkinson et al. | 473/431 |
| 7,722,485 | B2 | * | 5/2010 | Balasubramanyan | 473/422 |
| 2003/0101978 | A1 | * | 6/2003 | Smith et al. | 124/69 |
| 2007/0021242 | A1 | * | 1/2007 | Krickler | 473/451 |

FOREIGN PATENT DOCUMENTS

| | | | |
|---|---|---|---|
| JP | 02005218757 | * | 8/2005 |
| WO | WO 9717112 A1 | * | 5/1997 |

* cited by examiner

SENSOR BASED TENNIS SERVE TRAINING APPARATUS

CROSS-REFERENCE TO RELATED APPLICATION

This application claims priority to Application Ser. No. 61/256,225, filed 29 Oct. 2009, and Ser. No. 11/823,418, filed 27 Jun. 2007, which are herein incorporated by reference, which claims priority to application Ser. No. 11/582,597 filed 18 Oct. 2006, now U.S. Pat. No. 7,722,485.

FIELD

The present invention relates to tennis serve training apparatuses using optical markers and optical movement detection devices.

BACKGROUND

The tennis serve is a challenging skill and one of the most frustrating and the weakest links in a tennis player's game. Though ball machines exist for practicing ground strokes like forehand, backhand, volley and overhead, existing tennis serve devices to not adequately address tennis player service practice needs. Ball toss aids for tennis serve target practice exist, but none seem to put the ball in the right place and allow the player to actually hit it. The challenge of a tennis coach, as she watches the user struggle with the toss as a beginner or intermediate player, is to first get the player to toss the ball at the desired location, before getting her to hit the correct ball at the desired height. Coaching time is partly wasted because the user is actually tossing the ball in the incorrect position and thus hitting faulty serves.

For the intermediate player, a tennis coach has to struggle with finer points like refining the point of contact. No device exists that provides visual feedback on ideal point of contact between the racket and ball elevation when hitting the serve. Also, on the same lines it is very common for intermediate players to make contact with the ball lower than optimum, hitting incorrect serves. No visual feedback is currently available to a tennis coach to literally highlight this point.

SUMMARY AND ADVANTAGES

A sensor based tennis serve training apparatus includes a stand, a ball tosser coupled to said stand, an optical marker coupled to said stand and in electronic communications with said ball tosser, the optical marker to mark a ball strike zone, an ultrasonic tennis arm movement detector attached to said stand and in electronic communication with said ball tosser to detect arm movement, and a selectively timed ball discharging magazine attached to said stand and in electronic communication with said ball tosser. The stand can further be adjusted in height.

A sensor based tennis serve training apparatus includes a stand, a ball tosser coupled to said stand, an optical marker coupled to said stand and in electronic communications with said ball tosser, the optical marker marking a ball strike zone, an ultrasonic tennis arm movement detector attached to said stand and in electronic communication with said ball tosser detecting arm movement, and a selectively timed ball discharging magazine attached to said stand and in electronic communication with said ball tosser.

A sensor based tennis serve training apparatus can include an electronic communication control box coupled to said stand and mediating electronic communication between said magazine, ball tosser, ultrasonic tennis arm movement detector, and optical marker.

The sensor based tennis serve training apparatus presents numerous advantages, including: consistently tosses a tennis ball in a desired location; can toss a tennis ball in response to detection of a tennis player's rising tossing arm; can mark the upper and lower limits for optimum strike of a dropping tennis ball by a tennis players racket; can provide visual feedback where a ball is struck in other than an optimum strike zone; aids a tennis player to develop kinetic and visual memory of the correct ball toss position and point of contact; can be programmed to toss a tennis ball to a tennis player an appropriate height; allows a tennis player to practice tennis serves without actually releasing a tennis ball from the tennis players tossing arm; can be set up singlehandedly; can program in selected height and depth units for tossing and striking; can allow automatic feeding of tennis balls to the tennis player in response to sensing the tennis players tossing arm movement; can allow programming the start of the serving motion detection to be either the rising of the tossing arm or sensing the forward shifting weight of the user with a pressure sensing mat; can allow an adjustable time delay to customize the delay between start of serving action and ball toss from overhead ball toss canister; provides strike zone marking that is non-obstructive to the tennis strike Additional advantages of a sensor based tennis serve training apparatus will be set forth in part in the description which follows, and in part will be obvious from the description, or may be learned by practice of the sensor based tennis serve training apparatus. The advantages of the sensor based tennis serve training apparatus may be realized and attained by means of the instrumentalities and combinations particularly pointed out in the appended claims. Further benefits and advantages of the embodiments of the sensor based tennis serve training apparatus will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of a sensor based tennis serve training apparatus and, together with the detailed description, serve to explain the principles and implementations of the sensor based tennis serve training apparatus 50.

REFERENCE NUMBERS USED IN DRAWINGS

Figure 1:
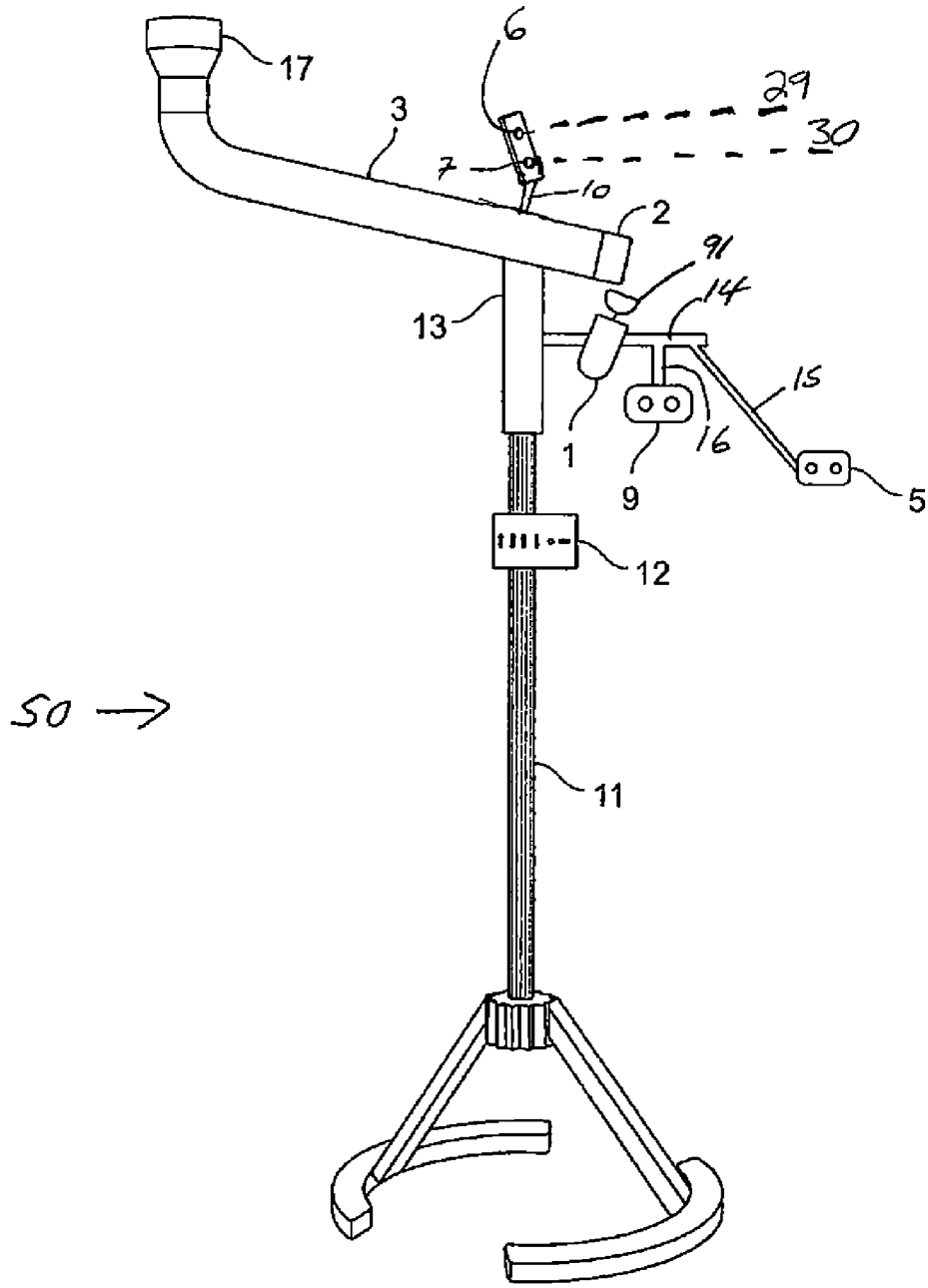
FIG. 1 shows a perspective view of a sensor based tennis serve training apparatus.

Turning now descriptively to the drawings, the figures illustrate a sensor based tennis serve training apparatus. The following numbering is used throughout the various drawing figures:

| | |
|---|---|
| 1 | Ball toss canister |
| 2 | Ball feed control |
| 3 | Magazine |
| 5 | First Motion Sensor |
| 6 | First Laser Marker |
| 7 | Second Laser Marker |
| 9 | Second Motion sensor |
| 10 | Inclined support |
| 11 | Post |
| 12 | Electrical control box |
| 13 | Support beam |
| 14 | Cross support |
| 15 | First Minor support |
| 16 | Second Minor support |
| 17 | Funnel |
| 21 | ON/OFF switch |
| 23 | Laser switch |
| 24 | Up/down switch |
| 25 | Ready indicator |
| 26 | Counter |
| 28 | Beam out by the first sensor |
| 29 | First laser line |
| 30 | Second laser line |
| 50 | Sensor based tennis serve training apparatus |
| 91 | Ball Holder Cup |
| 92 | Connecting rod |
| 93 | Hollow cylinder |
| 94 | Piston |
| 95 | Spring |
| 96 | Circuit Board |
| 97 | First Terminal |
| 98 | Second Terminal |
| 99 | Electrical coil |
| 100 | Casing |
| 101 | Casing opening |
| 111 | First Gate |
| 112 | Second Gate |
| 114 | First Servo |
| 115 | Second Servo |
| 116 | Wall |
| 130 | Microprocessor |
| 131 | Ready switch Circuitry |
| 133 | First Motion sensor Circuitry |
| 135 | Second Motion sensor circuitry |
| 136 | Ready notification circuitry |
| 137 | Solid state Relay |
| 138 | Trigger Circuitry |
| 139 | Solenoid in Tosser Unit |
| 140 | First Laser energizing circuitry |
| 142 | Second Laser energizing circuitry |
| 144 | Servo control circuitry |
| 200 | Schematic |
| 300 | Flow Chart |
| B | Ball |
| B1 | First Ball |
| B2 | Second Ball |
| B3 | Third Ball |
| T | Tennis court |
| N | Net |

DETAILED DESCRIPTION

Before beginning a detailed description of a sensor based tennis serve training apparatus, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As shown in FIGS. 1-9, a sensor based tennis serve training apparatus 50 is a microprocessor controlled, sensor driven, electro-mechanical ball machine for practicing the tennis serve by consistently tossing the ball in the desired location. A sensor based tennis serve training apparatus 50 tosses balls in a magazine via an overhead toss canister when it detects the user's rising tossing arm, and marks the desired height of contact on the dropping ball with a laser and provides visual feedback if the ball is being struck lower than optimum.

A sensor based tennis serve training apparatus 50 can operate in an auto-sense mode, detecting a rising tossing arm using two ultrasonic movement sensors. After a computed delay, a ball is tossed from the overhead ball toss canister, which is slightly above and to the left side of a right handed player's head. The ball is tossed in a parabolic path and is marked by a horizontal laser beam with a bright red dot as it falls through the optimum point of contact with the racket. If the ball is not hit by the player it falls lower and is marked by another horizontal line laser, which signifies that the ball has fallen beyond the strike zone. The user can practice hitting about serves with the balls in the magazine, before stopping to reload the magazine.

Figure 2:
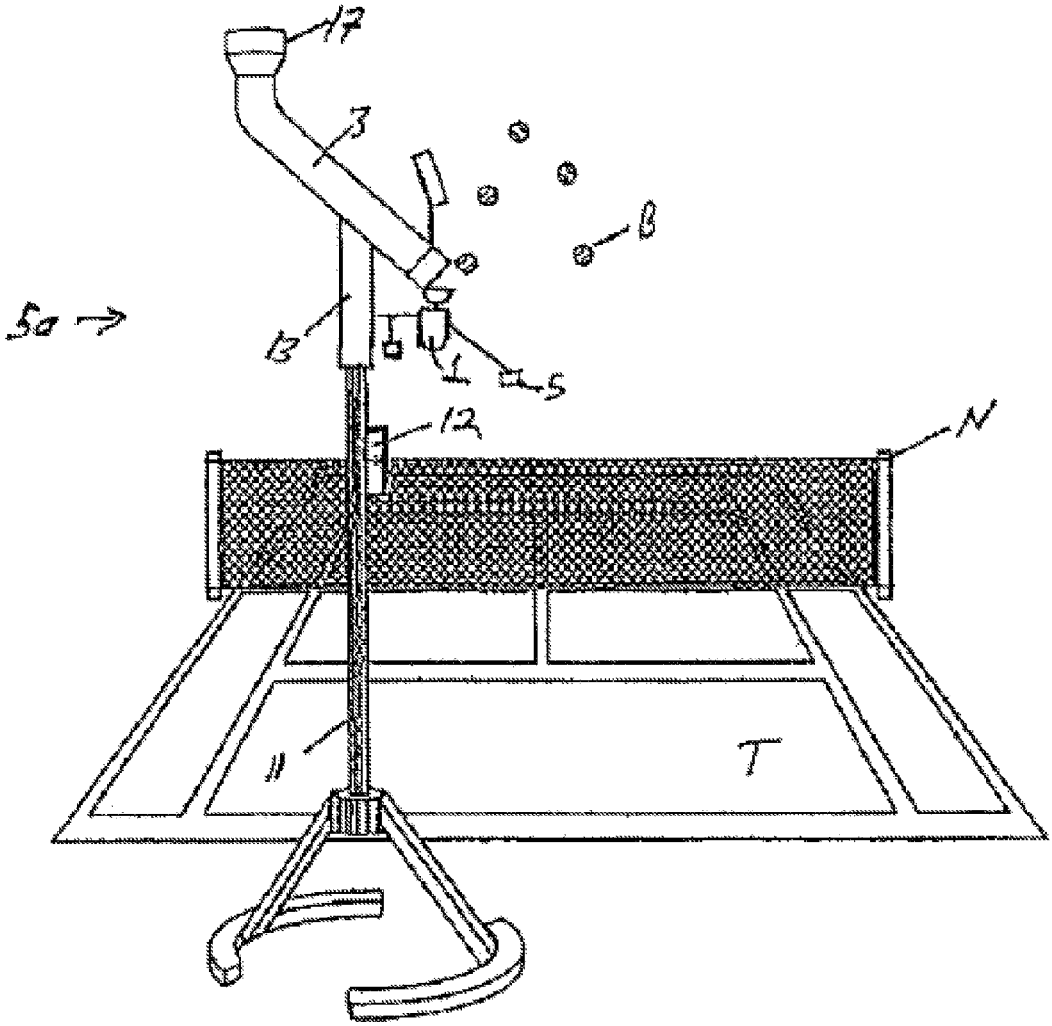
FIG. 2 shows a perspective view of sensor based tennis serve training apparatus in use.

FIG. 2 shows a sensor based tennis serve training apparatus 50 in relation to the court. User can position sensor based tennis serve training apparatus 50 such that the ball toss canister 1 tosses the ball, either directly in front of the player or more to the side, depending on the type of serve to be practiced While practicing with sensor based tennis serve training apparatus 50, the user does not actually release the tennis ball for the serve from her tossing hand, but performs the same motion like a real serve. A sensor based tennis serve training apparatus 50 senses the rising tossing arm of the user with sensors 5 and 9 of FIG. 1 and after a computed delay sends an impulse to the ball toss canister 1.

When the sensor based tennis serve training apparatus 50 is in the ready mode, indicated by ready indicator 25, the motion sensors 5 and 9 of FIG. 1 detects the rising tossing arm of the user above a certain height and provides input to the microprocessor.

Figure 3:
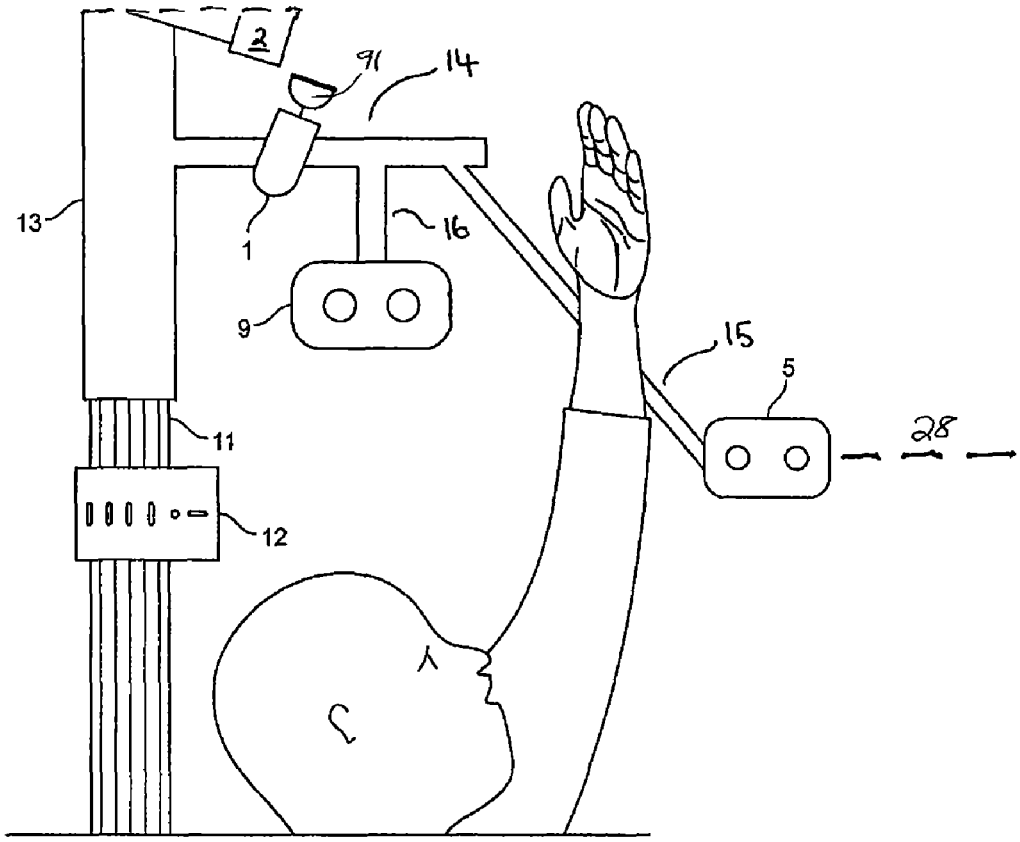
FIG. 3 shows a partial perspective view of sensor based tennis serve training apparatus in use.
Figure 4:
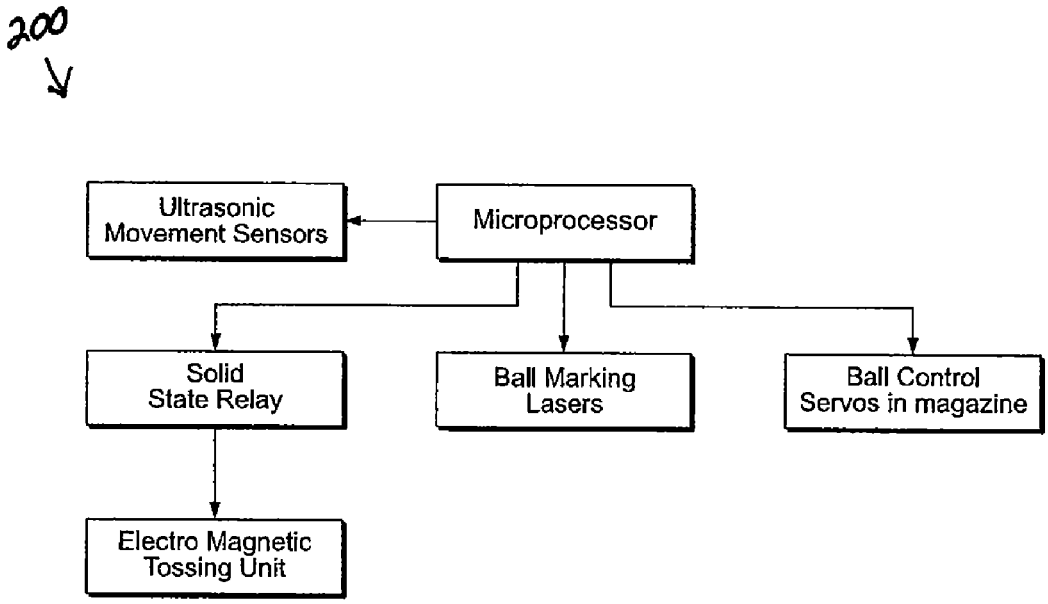
FIG. 4 shows a schematic for a sensor based tennis serve training apparatus.

In relation to the tossing arm aspect of the sensor based tennis serve training apparatus 50. The user pretends to be tossing a ball while practicing the serve by raising her tossing arm above her head. As FIG. 3 illustrates, sensor 5, which is an ultrasonic sensor, detects the movement of the arm a height range of 1-6 inches above the players head and in front. FIG. 3 shows the beam 28 put out by the sensor 5. The second sensor 9, also an ultrasonic sensor, detects further movement about 8 to 12 inches above the players head.

Motion sensors 5 and 9 are mounted to minor supports 15 and 16 respectively. These minor supports are attached to support 13 by means of a cross support 14. Since the motion sensor 5 and 9 are riding the support-beam 13, its range of sensing is a function of height of the ball toss canister 1. So a tall player about 6'2" would set the ball toss canister height at about seven feet. The motion sensors will detect the tossing arm in the height range of 6'3" to 6'8". When the ball release canister height is lowered for a short player of about 5'2", then the ball toss canister 1 height would be in the range of 6 feet and the motion sensors will sense the tossing arm motion between 5'3" and 5'8".

In an embodiment, motion sensors 5, 9 are based on a crystal-locked ultrasonic movement detection. The circuit has a transmitter based on 40 KHZ crystal driving an oscillator power by CD4049. The receiver is based on LM324 amplifiers. The transmitter section of the detector is basically a crystal-controlled relaxation oscillator built around a 4048 hex inverter. The receiver section of the circuit is made of AC coupled stages built around sections of LM324 op-amp.

The range of motion sensing height can be adjusted. To prevent false triggers, the software accepting this input will have its sensitivity adjusted so once triggered the software will not accept input until its ready for another cycle in about 5 seconds. Motion sensors 5, 9 will trigger within three feet range and will not be triggered by the falling ball or other movements around the sensor based tennis serve training apparatus 50.

The software, operating as shown in the flow chart 300, running in the microprocessor 130 processes the two movements and the time interval between them to compute a delay for triggering the ball toss at the appropriate instant. The presence of two motion sensors 5, 9 prevents false triggering to the ball tossing unit.

Figure 9:
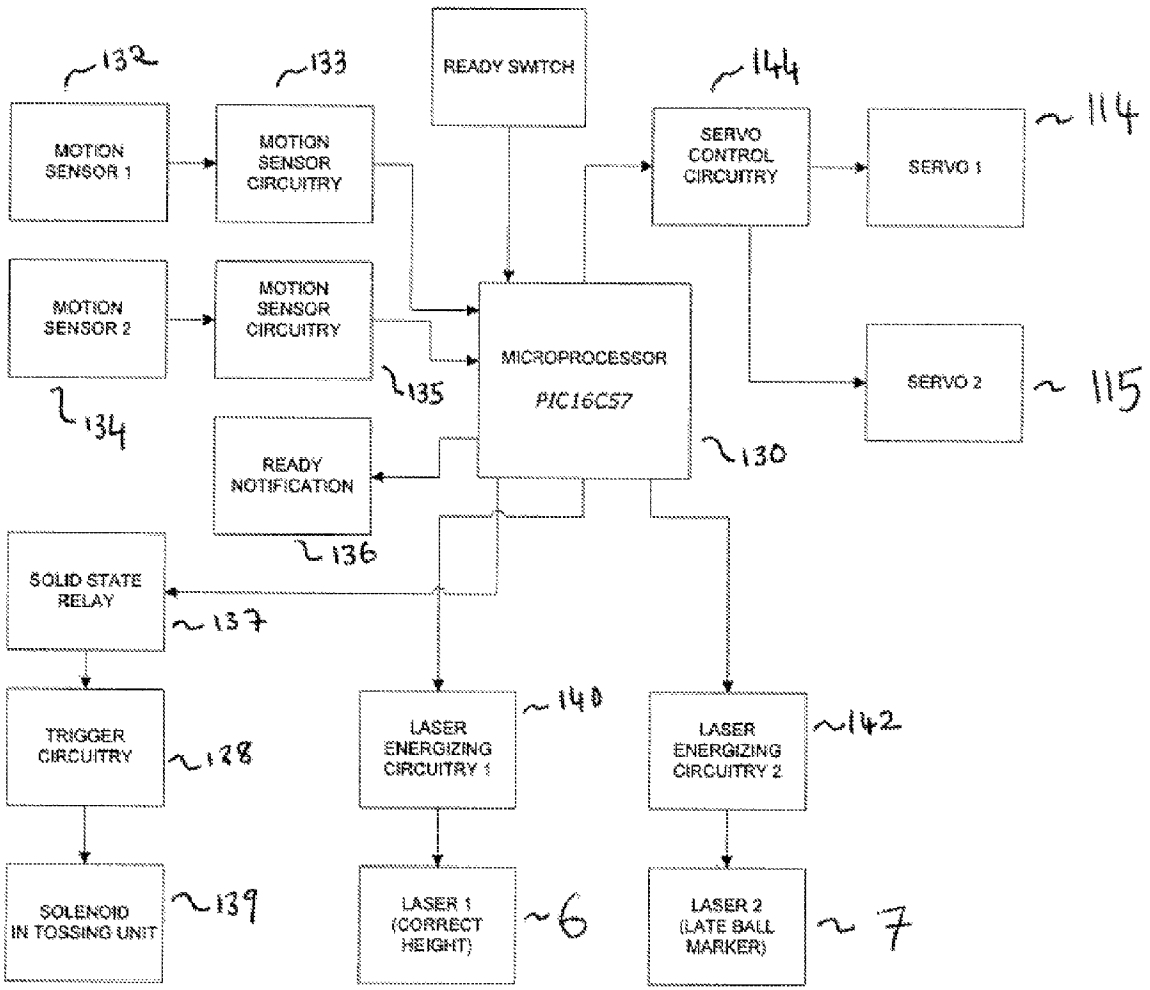
FIG. 9 shows a wiring diagram for a sensor based tennis serve training apparatus.

The subsystems of a sensor based tennis serve training apparatus are controlled by a microprocessor 130 (Based on PIC16C57) with software written in PBASIC. FIG. 9 shows the electrical systems controlled by the microprocessor.

Figure 6:
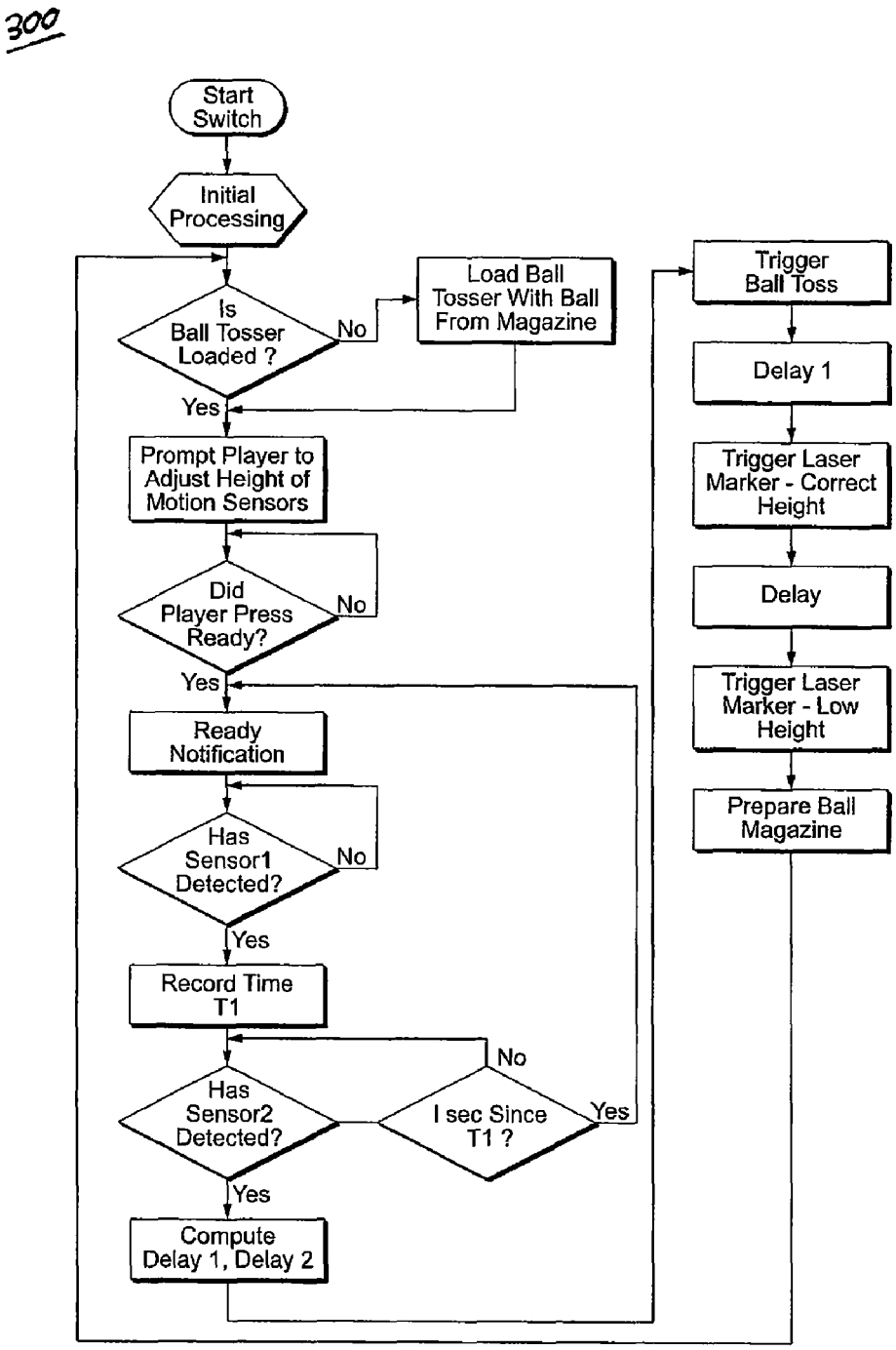
FIG. 6 shows a flow chart of software for a sensor based tennis serve training apparatus.

FIG. 6 shows the flow chart 300 of the software program. The software as loaded on a computer executes the following: processes input from the motion sensors; initiates signal for ball tossing unit; activates lasers to mark the ball; ball feed mechanism.

The ball toss canister 1 is triggered to release the ball by an electrical impulse received from a Solid-State Relay 137 that is fed by the microprocessor 130. The software program computes a delay based on the time difference between the two sensor timings. The delay in the order of milliseconds is based on the time difference between the signals received between the two motion sensors.

As shown in FIG. 1, the ball toss canister 1 is attached to the magazine 3. When a ball is tossed by the ball toss canister 1, the ball feed control 2 is also activated by a delayed electronic signal by the software program and the magazine 3 releases one ball. The ball travels by gravity from the magazine 3 and drops into the ball toss canister 1.

Ball toss canister 1 tosses the ball at the desired height at the appropriate time in the serving motion. As FIG. 1 shows, a ball toss canister 1 that tosses one ball at a time from its overhead position. The ball toss canister 1 is compact and sized to hold only one ball. The ball toss canister 1 is positioned about 12 to 18 inches above the player, to the left side (for a right hander) and slightly in front, thus putting it out of swing path of the racket.

The ball toss canister 1 of FIGS. 1, 2, 3, 7 is a cylinder placed at one end of the magazine 3. It holds one ball in place by means of a cup shaped holder 91. This cup holder 91 ejects ball in response to piston 94 motion, causing the ball to be tossed. The ball toss canister 1 receives its trigger from the microprocessor 130.

The ball toss canister is based on an electromagnetic design. The unit has a tossing cup 91 which is attached to a piston 94. The piston 94 rests in an Electromagnetic coil 99 or a solenoid. The piston 94 in the solenoid is used as a hammer to toss the ball resting in the tossing cup 91. First current flows one way through the coil 99 repelling the magnetic piston 94. The circuitry then reverses the current and this pushes the piston 94 the other way expelling the ball from the tosser. The solenoid gets its electrical trigger signal from a solid-state relay. The relay in-turn is activated by the software running in the microprocessor. A metal spring 95 resets the position of the cup back to the old position. The electromagnetic design promotes consistency in tossing the ball.

Figure 7:
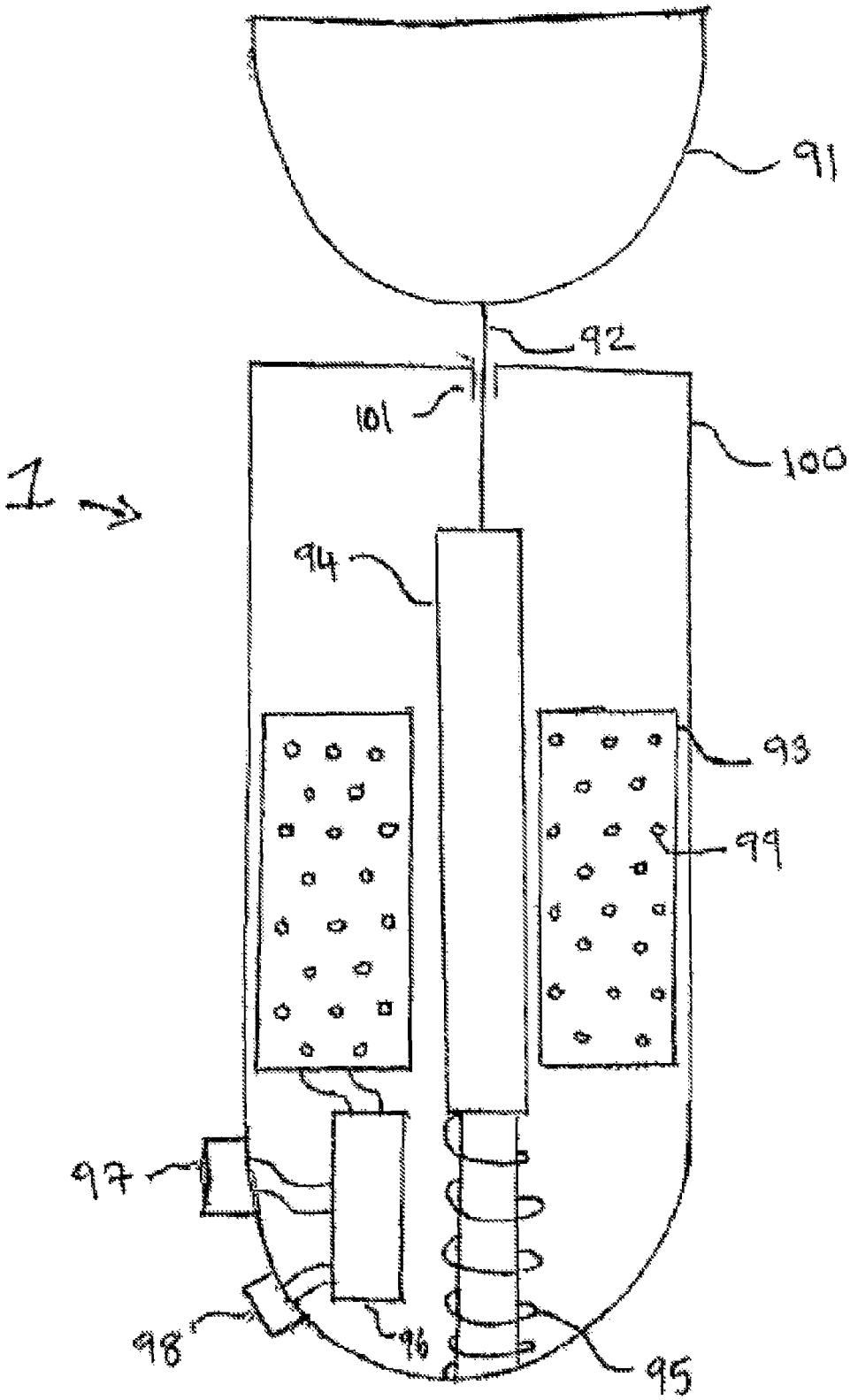
FIG. 7 shows a cross section of a ball toss canister for a sensor based tennis serve training apparatus.

Ball holder cup 91 is attached by connecting rod 92 to piston 94. Piston 94 is held in place inside a hollow cylinder 93 which has electrical coil 99 wound inside it. This electrical coil 99 inside the cylinder is what causes the strong magnetic force that propels the piston 94 inside the casing 100. The piston 94 is supported at the base by a spring 95 that is attached to the casing 100. At the top the piston is supported by connecting rod 92 that is held in place by the opening 101 in the casing 100. FIG. 7 also shows the wiring inside casing 100 for the magnetic coil 99 and the controlling circuitry. The casing exposes two terminals. First Terminal 97 is for the power supply to the tossing unit. Second Terminal 98 accepts input signal from the microprocessor. The controlling circuitry that energizes the tossing unit and the solid-state relay is represented by circuit board 96. The ball toss canister 1, which holds one ball, has an piston 94 action, like an electrical hammer, to toss the ball about 30-36 inches consistently into the air in a parabolic path. The canister 1 is fed by a feed control 2 on a magazine 3 which is a slightly inclined horizontal pipe with a funnel 17 at the other end.

The balls B in the magazine 3 roll into the ball toss canister 1, one at a time regulated by a servo 114, 115 activated ball feed control 2. The magazine 3 is attached to a support beam 13 that can ride vertically on a threaded vertical rod 11. The support beam 13 also supports the sensor apparatus 5, 9, 14, 15, 16, and laser apparatus 6, 7, 10. This support beam 13 can be raised and lowered with electrical power assistance. The support beam 13 can be lowered, so the magazine 3 is at about six feet above ground, to enable easy loading of the balls. The fine adjustments for the laser and motion sensor apparatuses will also be performed when the support beam 13 is in the lowered position.

As the ball B is tossed from the canister 1, it goes up from the left side of a right handed tennis player and comes down in a parabolic path in front of the player. The player can optionally use the laser marker 6, to illuminate the ball B at the elevation where she would ideally like to make contact with the racket. Laser marker 7, illuminates the ball B with an inch wide horizontal line about six inches below the elevation of the first laser 6 as shown in FIG. 1. If the racket impacts with the ball after laser marker 7 have illuminated the ball, this usually signifies that the user is making late contact and allowing the ball to drop low. The exact setting of the laser markers 6 and 7 can be adjusted with the magazine assembly in the lowered position.

FIG. 9 shows the electrical wiring diagram for various subsystems of the sensor based tennis serve training apparatus 50. The microprocessor 130 is at the heart of the control of the entire system. The microprocessor's I/O ports are wired to the ready switch 131, motion sensor circuitry 133 and 135 as inputs. The microprocessor's I/O ports are wired to the ready notification circuitry 136, solid-state relay 137, laser energizing circuitry 140 and 141 and servo-control circuitry 144 as outputs. The motion sensor circuitry 133 and 135 in turn are wired to their respective motion sensors 132 and 134. The servo control circuitry 144 control the servos 114 and 115. The laser energizing circuitry 140 and 142 are wired to their respective lasers 6 and 7.

There are two laser markers to aid the user with recognizing an optimum point of contact between racket and ball. The laser markers 6 and 7 of FIG. 3 are optional and are enabled by switch 23 of FIG. 5. The laser markers are energized only for couple of seconds after the ball is released by the ball toss canister, to conserve the life of the laser and energy. Markers 6 and 7 are attached to inclined support 10 which is screwed onto support beam 13. This allows the laser markers to move along with the ball toss canister when its height is adjusted. The laser markers 6 and 7 are fixed on swiveling mounts and the direction of the beam can be adjusted during calibration for a particular individual. Markers 6 and 7 as shown in FIG. 1 and FIG. 3 are positioned on the support beam 13 that rides vertically with the ball toss canister height adjustment. Marker 6 is positioned in such a way that it focuses a spot in the trajectory of the ball that is the ideal point of contact. Marker 7 is positioned to mark an inch wide horizontal line on the tossed ball about 6 inches below the spot marked by marker 6. FIG. 3 shows the laser line 29 put out by marker 6 and laser line 30 put out by marker 7. Using two laser markers allows improvement in the serve because the player can focus on making contact with the ball B near or on the spot marked by marker 6 as shown in FIG. 3. If user continues to see the horizontal line on the ball before the user makes contact, then its apparent to both that the ball is being struck lower than desired.

Figure 8:
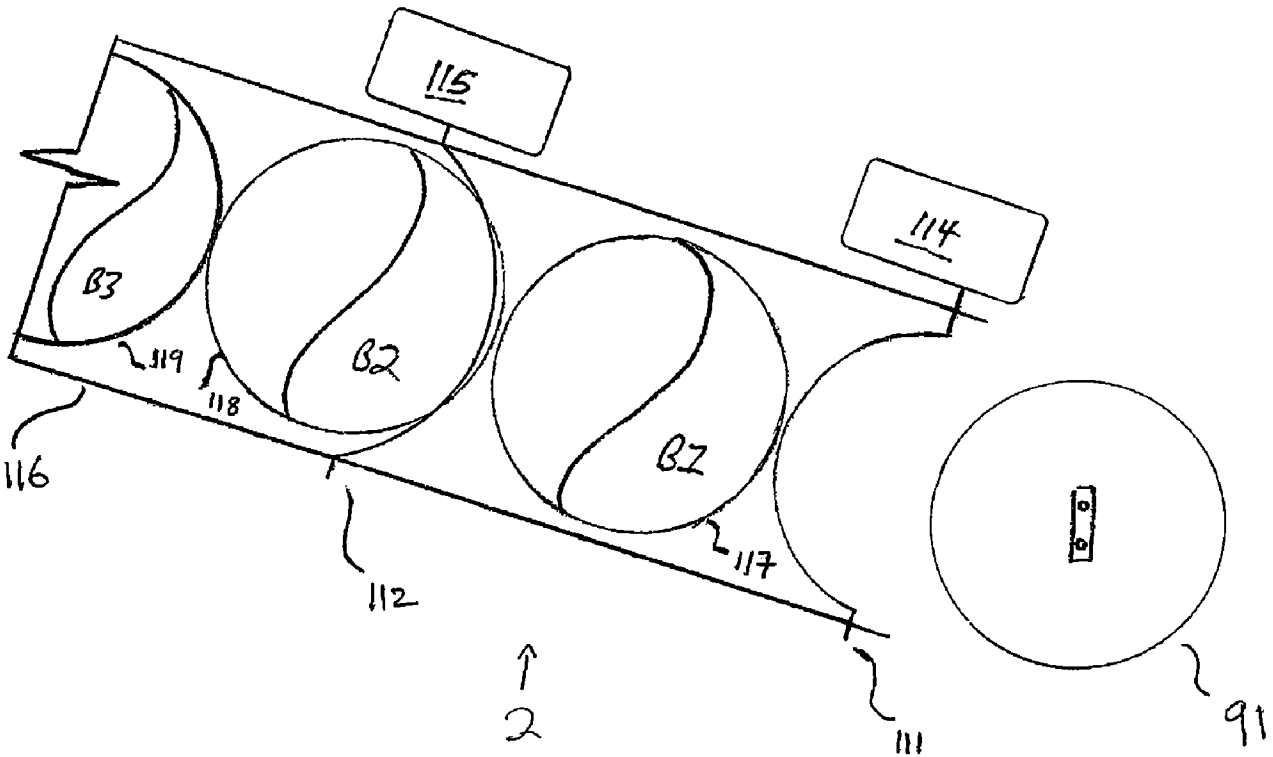
FIG. 8 shows a ball feed control for a sensor based tennis serve training apparatus.

FIG. 8 shows the top view of the cross section of the magazine with ball feed control 2. The ball feed control 2 is placed at the end of the ball magazine 3 and allows orderly placement of one ball B into the ball holder cup 91. For ease of explanation, the balls in the feed mechanism are named B1, B2, and B3. There are two gates that control the flow of the balls into the ball holder cup 91. The gates are mounted inside the cylindrical wall 116 of the feed control 2 portion of the magazine 3. First gate 111, allows the ball B1 at the very end to roll out into ball holder cup 91. First gate 111 is controlled by servo 114 and second gate 112 is controlled by servo 115. The second gate 112 keeps ball B2 from rushing into ball B1 when first gate 111 opens. Second gate 112 opens when first gate 111 has closed after ball B1 has exited the feed control tube. This allows ball B2 to take up the position of ball B1 behind first gate 111. Ball B3 then rolls into the erstwhile position of ball B2. The timing and synchronization of the servos is controlled by the software running in the microprocessor.

Figure 5:
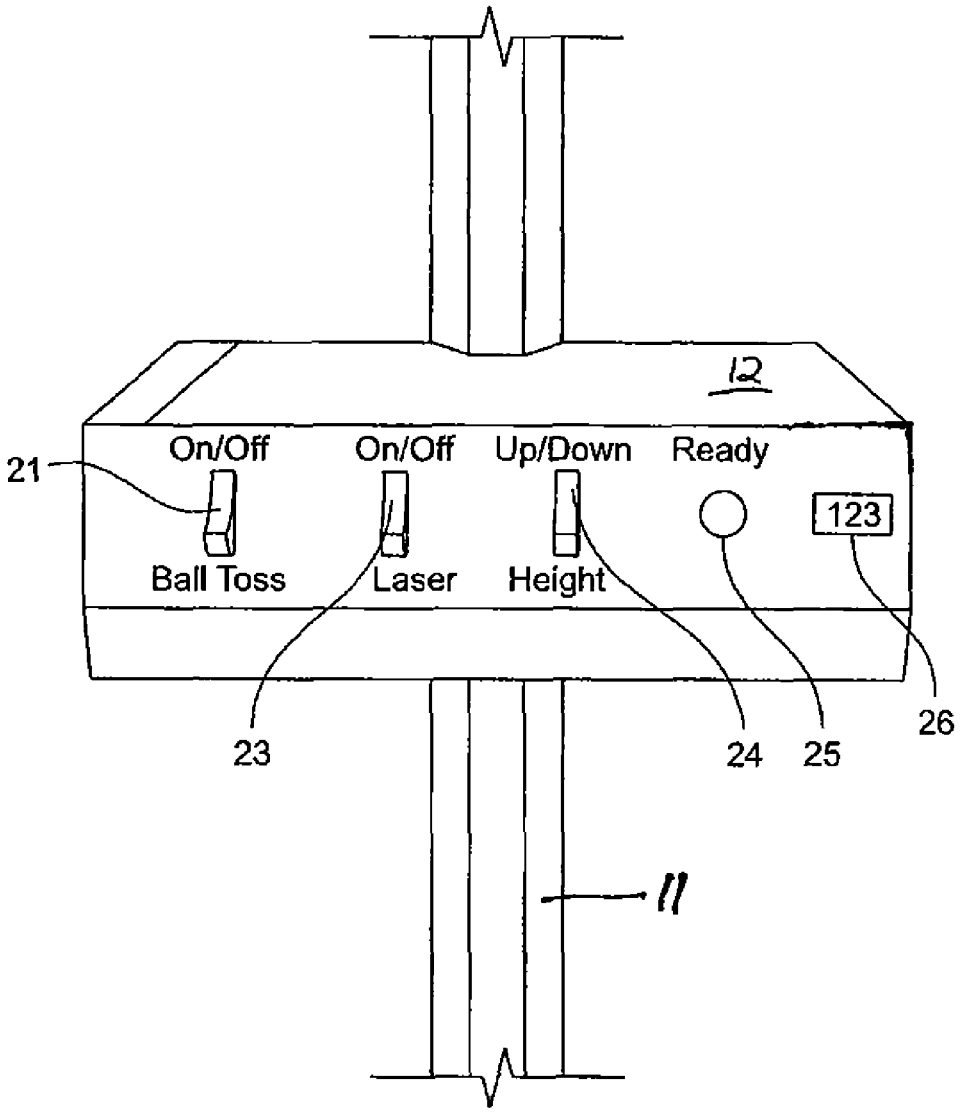
FIG. 5 shows an electronic control box for a sensor based tennis serve training apparatus.

The magazine 3 is attached to the support beam 13, and the ball toss canister 1 is attached to the cross support 14 which in turn is attached to the support beam 13. The support beam 13 rides vertically up and down the post 11 of FIG. 1. This will allow the support beam 13 and all attached components to be set to the desired height. The height of the ball release canister 1 is adjusted by using the up/down switch 24 of FIG. 5. A counter 26 in FIG. 5 gives readout of the height of the ball release canister above the ground in inches. This readout of the height aids the user to set the machine when re-starting practices.

An electrical control box 12 is in electrical feed control 2, motion sensors 5, 9, laser markers 6, 7, and ball toss canister 1. The electrical control box 12 also includes a ready indicator 25, and a counter 26. While the magazine is in the lowered position, is when it is loaded with the balls. First the ON/OFF switch 21 of FIG. 5 is moved to the OFF position to de-energize the power to the ball toss canister 1 The Up/Down switch 24 in FIG. 5, is depressed down for the magazine assembly to be lowered to its lowest height about six feet above the ground. When the magazine assembly is in the lowered position, the balls can be tossed into the funnel 17 of FIG. 1. The funnel aids the balls to trickle into the magazine, which holds about ten to twelve balls. After the balls are loaded, the Up/down switch 24 in FIG. 5 is pushed up to raise the magazine assembly to the desired height. The height readout of the counter 26 of FIG. 5 helps with setting the ball release canister at the height desired.

The user positions the sensor based tennis serve training apparatus 50 behind the base line of the tennis court as shown in FIG. 2. The user connects the power supply by plugging in the power cord into a utility socket. The user proceeds to load the balls into the magazine. To do this, the up/down switch 24 in FIG. 5 is pushed down to bring the magazine assembly to its lowest point. Balls are then tossed into the funnel 17 of FIG. 1 to load the magazine. The magazine can hold up to 12 balls. After the balls are loaded, the rocker switch is pushed up to raise the magazine assembly so that the ball toss canister 1 is at the desired height. The user positions the ball toss canister 1 to toss the ball in the correct trajectory for the user to hit.

The reading in counter 26 of FIG. 5, which is the height of the ball toss canister above the ground, is noted for future setting. The user then waits for the sensor based tennis serve training apparatus 50 to initialize and prompt her with a "Ready" audible tone.

The user then proceeds to the service line to take a practice swing for tennis serve. To calibrate the sensor based tennis serve training apparatus 50 correctly for her serve, the user needs to adjust the height of the support beam 13 until the tossing arm detection unit detects her tossing arm and tosses the ball from the ball toss canister 1 at the appropriate moment. In the first couple of practice serves, the user may realize that the ball is being tossed to soon or too late in the serving motion for the ball to be struck effectively.

The user can then watch the laser marking on the ball to make sure she is hitting the ball at the optimum height. There is a dot laser and a short horizontal line laser marking. The user should aim to make contact between racket and ball, when the ball is marked by a dot laser. If the user finds herself hitting the ball after horizontal line markings, it is apparent that the ball is being struck lower. The laser markings are optional and can be turned off by switch 23 of FIG. 5.

A sensor based tennis serve training apparatus includes a stand, a ball tosser coupled to said stand, an optical marker coupled to said stand and in electronic communications with said ball tosser, the optical marker to mark a ball strike zone, an ultrasonic tennis arm movement detector attached to said stand and in electronic communication with said ball tosser to detect arm movement, and a selectively timed ball discharging magazine attached to said stand and in electronic communication with said ball tosser.

A sensor based tennis serve training apparatus includes a stand, a ball tosser coupled to said stand, an optical marker coupled to said stand and in electronic communications with said ball tosser, the optical marker marking a ball strike zone, an ultrasonic tennis arm movement detector attached to said stand and in electronic communication with said ball tosser detecting arm movement, and a selectively timed ball discharging magazine attached to said stand and in electronic communication with said ball tosser.

A sensor based tennis serve training apparatus can include an electronic communication control box coupled to said stand and mediating electronic communication between said magazine, ball tosser, ultrasonic tennis arm movement detector, and optical marker.

A sensor based tennis serve training apparatus having a stand that can be adjusted in height.

A tennis serve training system allows a player to practice tennis serves with balls tossed at the optimum height and location in the court, and includes an inverted 'L' shaped structure with base and upright pillar behind the user, comprising of a ball toss canister that is fed by a magazine, being an inclined ball chute that holds balls, positioned above and angled for appropriate delivery of the ball to a tossing mechanism, that is positioned to the side of the user so as to be out of the way of the swing of the serve and that tosses the ball in a trajectory, like a user tossed the ball herself for a serve, which employs a lowerable magazine for easy ball loading.

Those skilled in the art will recognize that numerous modifications and changes may be made to the preferred embodiment without departing from the scope of the claimed invention. It will, of course, be understood that modifications of the sensor based tennis serve training apparatus 50, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the sensor based tennis serve training apparatus should not be limited by the particular embodiments herein described but should be defined only by the appended claims and equivalents thereof.

I claim:

1. A sensor based tennis serve training apparatus, comprising:

A ball tosser configurable to actively release a ball upon electronic impulse;

A detector detecting relative rising movement of a tossing arm in electronic communication with said ball tosser providing electronic impulse to trigger ball tosser activation;

An optical marker marking a moving ball with a laser at a user selected height of contact; and An optical marker providing visual feedback on the ball if the ball is struck below the user selected height of contact.

2. A sensor based tennis serve training apparatus, comprising:

A ball tosser configurable to actively release a ball upon electronic impulse;

A detector in electronic communication with said ball tosser detecting relative rising tossing arm movement using two ultrasonic movement sensors to trigger launch of said ball by said ball tosser through an electronic impulse;

Optical markers marking by horizontal laser beam the ball with a visible dot as the ball falls through the user selected point of contact; and Optical markers marking with a horizontal laser the ball when it falls below a preset strike zone.

3. The apparatus of claim 1 or 2, wherein said active release is accomplished by launching said ball upward into the air.

* * * * *